US006979285B2

(12) United States Patent
Lovison

(10) Patent No.: US 6,979,285 B2
(45) Date of Patent: Dec. 27, 2005

(54) HAND GRIP EXERCISE SYSTEM

(76) Inventor: Douglas I. Lovison, 1392 Rubenstein Ave., Cardiff, CA (US) 92007

( * ) Notice: Subject to any disclaimer, the term of this patent is extended or adjusted under 35 U.S.C. 154(b) by 0 days.

(21) Appl. No.: 09/877,577

(22) Filed: Jun. 7, 2001

(65) Prior Publication Data

US 2002/0187883 A1 Dec. 12, 2002

(51) Int. Cl.[7] ..... A63B 21/068

(52) U.S. Cl. ..... 482/95; 482/132; 482/141; 482/907

(58) Field of Search ..... 482/79, 92, 95, 482/96, 106–108, 127, 132, 141, 148, 907, 482/68, 78; D21/679, 691, 662; 472/133; 280/47.11, 87.01; 601/129, 125, 134–137; D24/211, 214

(56) References Cited

U.S. PATENT DOCUMENTS

| | | | | | |
|---|---|---|---|---|---|
| 1,438,804 | A | * | 12/1922 | Albizu | 482/108 |
| 1,779,594 | A | * | 10/1930 | Hall | 482/107 |
| 1,824,920 | A | * | 9/1931 | Novak | 482/132 |
| 2,821,394 | A | | 1/1958 | Barbeau | |
| 3,134,590 | A | | 5/1964 | Young | |
| 3,403,906 | A | * | 10/1968 | Burzenski | 482/132 |
| 3,796,431 | A | | 3/1974 | Sinyard | |
| 3,797,824 | A | * | 3/1974 | Osbourne | 482/132 |
| 3,809,393 | A | | 5/1974 | Jones | |
| D243,013 | S | * | 1/1977 | Jones et al. | D19/37 |
| 4,171,805 | A | | 10/1979 | Abbott | |
| 4,225,132 | A | | 9/1980 | Archambault | |
| 4,339,127 | A | * | 7/1982 | Mitchell | 482/132 |
| 4,455,020 | A | * | 6/1984 | Schnell | 482/106 |
| 4,595,197 | A | | 6/1986 | Hagstrom | |
| D287,526 | S | * | 12/1986 | Brockett et al. | D21/681 |
| 4,775,147 | A | | 10/1988 | Bold | |
| 4,900,017 | A | | 2/1990 | Bold | |
| 5,221,244 | A | * | 6/1993 | Doss | 482/106 |
| 5,222,930 | A | | 6/1993 | Bold | |
| 5,230,684 | A | * | 7/1993 | Wallisch | 482/141 |
| 5,312,314 | A | * | 5/1994 | Stephan et al. | 482/110 |
| 5,741,206 | A | * | 4/1998 | Anastasi | 482/105 |
| 6,436,015 | B1 | * | 8/2002 | Frasco et al. | 482/106 |

(Continued)

FOREIGN PATENT DOCUMENTS

| | | | | |
|---|---|---|---|---|
| DE | 2035895 | * | 1/1972 | 482/132 |
| DE | 3108830 A | * | 9/1982 | A63B 11/00 |

OTHER PUBLICATIONS

Universal, Physical Conditioning Equipment, 1985 Catalog, pp. 36-37.*

(Continued)

*Primary Examiner*—Jerome Donnelly
*Assistant Examiner*—Victor K. Hwang
(74) *Attorney, Agent, or Firm*—Kenneth P. Krohn

(57) ABSTRACT

The present invention is a pair of hand grips that are to be rolled along a surface during an exercise routine. In more detail, each hand grip has an elongated, substantially straight, cylindrical crossbar with a first end and a second end. A first wheel is rotatably mounted at the first end of the crossbar and a second wheel is rotatably mounted at the second end of the crossbar. In operation, the wheels rotate about an axis that is defined between the ends of the crossbar, to move the hand grip over a surface. Movement of the hand grip over the surface can vary, depending upon the particular exercise routine being followed by the user. In order to perform an exercise routine, the user can assume a kneeling position, a sitting position or a bending-at-the-waist position.

10 Claims, 2 Drawing Sheets

U.S. PATENT DOCUMENTS

| | | | | |
|---|---|---|---|---|
| 6,602,170 | B2 * | 8/2003 | Ilic | 482/132 |
| 6,773,379 | B1 * | 8/2004 | Bing | 482/132 |
| 6,837,833 | B2 * | 1/2005 | Elledge | 482/108 |
| 6,837,837 | B2 * | 1/2005 | Nethery | 482/132 |

OTHER PUBLICATIONS

Bodybuilder's Discount Outlet, Summer 1995 catalog, pp. 31-32.*

* cited by examiner

HAND GRIP EXERCISE SYSTEM

FIELD OF THE INVENTION

The present invention pertains generally to exercise equipment. More particularly, the present invention pertains to portable exercise equipment that is interactive with a surface. The present invention particularly, though not exclusively, pertains to a pair of hand grips that are used interactively with a surface during an exercise routine.

BACKGROUND OF THE INVENTION

Exercise devices are typically designed to employ the physical principle of action and reaction. Specifically, insofar as exercise devices are concerned, this means there is always an interaction between the exercise device and the person performing an exercise with the device. Exercise devices that are based upon this action/reaction principle can be generally divided into three categories. One type of such exercise devices are devices that cause the user to move weight against the force of gravity, such as dumbbells. Another type are the exercise devices that generate internal resistance in response to activity of the user, such as stationary bikes. Lastly, there are so-called isometric exercise devices that are designed to use the person's own body weight as a resistance. Resistance created by these isometric devices can be either static, when the body remains stationary, or dynamic, when the body itself changes position. Stated differently, exercise devices that generate dynamic resistance require the body to move. Dynamic resistance devices are usually advantageous due to the simplicity in their operation which, in general, require that body muscles do the work of operating the device. For example, the abdominal muscles can be used to push and pull a rolling device along the surface. These devices are also advantageous because of their size and the ease of use. However, the disadvantage of such exercise devices is that there usually is only one method of using them. Furthermore, these devices are often designed for exercising limited muscle groups of the user's body.

In light of the above, it is an object of the present invention to provide an exercise device that effectively utilizes a person's own body weight as resistance during an exercise routine. Another object of the present invention is to provide an exercise device that can be used for various floor exercise routines in a somewhat small area of space. Another object of the present invention is to provide an exercise device that is versatile in exercising different muscles of the user's body. Yet another object of the present invention is to provide an exercise device that is lightweight, portable and comfortable to use. Still another object of the present invention is to provide an exercise device which is easy to use, relatively simple to manufacture and comparatively cost effective.

SUMMARY OF THE PREFERRED EMBODIMENTS

The present invention is directed to an exercise device that is interactive with a surface, such as a floor. More particularly, the present invention is a pair of hand grips that are to be rolled along a surface during an exercise routine. In more detail, each hand grip has an elongated, substantially straight, cylindrical crossbar which has a first end and a second end that, together, define an axis. Preferably, the crossbar of the present invention is made of a hard plastic or some other stiff material that is covered with a firm foam material. Further, the hand grip of the present invention includes a first wheel that is rotatably mounted at the first end of the crossbar and a second wheel that is rotatably mounted at the second end of the crossbar. Each wheel has a rounded rim and a hub. Also, there is a bearing assembly that is disposed between the hub and the crossbar to reduce axle friction as the wheel rotates around the end of the crossbar. As intended for the present invention, each wheel has a diameter of approximately four inches and is made of neoprene.

In an alternative embodiment of the present invention, a retainer clip is attachable to each end of the crossbar. Each wheel can then be rotatably positioned at a respective end of the crossbar and held on the crossbar by a retainer clip. As so used, the clips provide for a quick connect/disconnect of each wheel with the crossbar. Additionally, the crossbar can be formed with a bow or bend in its center. For this embodiment, the bow is formed so that the crossbar is bent at an approximately forty-five degree (45°) angle to establish two identifiable grips on the crossbar. Specifically, each of these grips will be located between a respective wheel and the center of the crossbar.

In operation, each wheel of the device rotates about the axis defined between the ends of the crossbar, to move the device over a surface. Specifically, movement of the device over the surface can follow a variety of paths, depending upon the particular exercise routine being followed by the user. In each instance, however, the device will be moved so that the body position of the user is changed during the routine. The object here is to allow muscle groups of the body to cyclically respond to the forces that are created as the body position changes. Preferably, in order to maximize the isometric response of the body, the axle friction is less than the rolling friction.

In order to perform an exercise routine, a user can assume a kneeling position, a sitting position or a bending-at-the-waist position. Assuming any of these positions, the individual will hold the hand grip(s) with his/her hands and roll the device back and forth on the surface. As indicated above, the user has the option to roll the hand grip along various preselected paths. Specifically, for some exercise routines, the user can roll each hand grip along generally parallel paths. Alternatively, the user can roll the hand grips along curved diverging/converging paths or along a lateral path. As also contemplated for the present invention, these various paths can be performed in various combination, as desired by the user.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
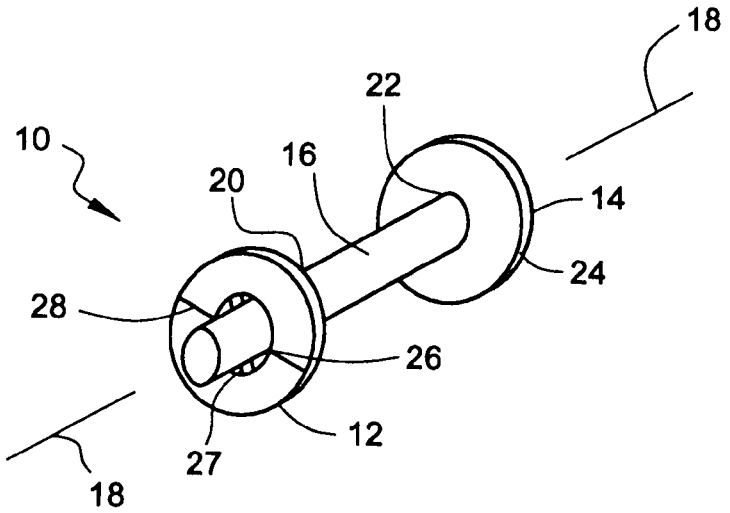
FIG. 1 is a prospective drawing of a hand grip of the present invention.

Referring initially to FIG. 1, a hand grip in accordance with the present invention is shown and is generally designated 10. As shown, the hand grip 10 includes a first wheel 12 and a second wheel 14 that are interconnected by a crossbar 16 which defines an axis 18. In more detail, the crossbar 16 is elongated and cylindrical in shape and has a first end 20 and a second end 22. Also shown in FIG. 1, the first wheel 12 is rotatably mounted at the first end 20 of the crossbar 16 and the second wheel 14 is rotatably mounted at the second end 22 of the crossbar 16. For the present invention, the crossbar 16 is preferably made of a hard plastic and is covered with a firm foam material.

Still referring to FIG. 1, the wheels 12 and 14 of the present invention each have a rounded rim 24 and a hub 26. The hub 26 includes a bearing assembly 27 that is disposed between the hub 26 and the crossbar 16 to reduce any axle friction. The diameter 28 of wheel 12 and wheel 14 can be approximately four inches. Further, the wheels 12 and 14 are preferably made of neoprene.

Figure 2:
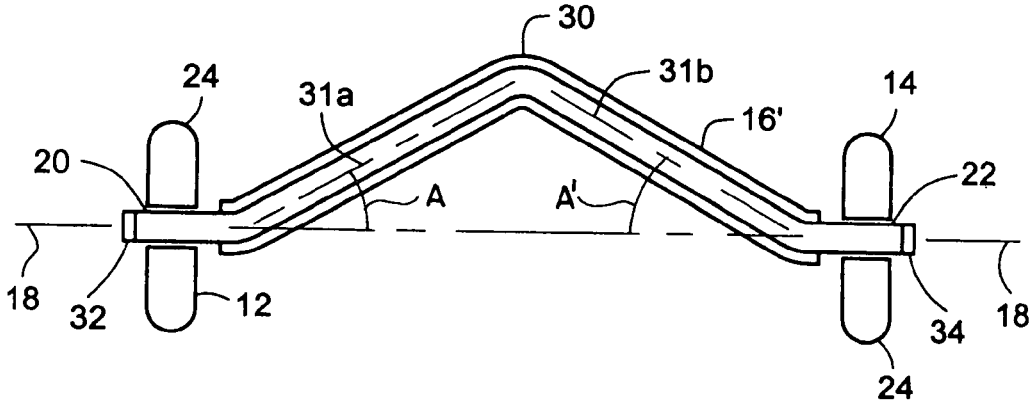
FIG. 2 is an alternate embodiment of a cross-bar for use with a hand grip in accordance with the present invention.

FIG. 2 shows an alternative embodiment of the present invention having a crossbar 16' formed with a bow 30, or bend, at the center of the crossbar 16. As shown, the bow 30 effectively establishes a grip 31*a* between end 20 and bow 30 of the crossbar 16'. Similarly, a grip 31*b* is established between the end 22 and the bow 30 of the crossbar 16'. Specifically, the bow 30 is bent at an approximately forty-five degree angle, as illustrated by angles A and A' in FIG. 2. Also shown in FIG. 2 is a first clip 32 that is attached to the first end 20 of the crossbar 16, and a second clip 34 that is attached to the second end 22 of the crossbar 16. Each of the wheels 12 and 14 can be rotatably attached to their respective ends 20 and 22 of the crossbar 16 by clips 32 and 34. The clips 32 and 34 of the present invention can be any quick connect/disconnect mechanism known in the art.

Figure 3A:
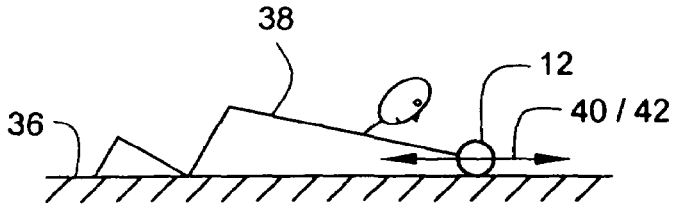
FIG. 3A is a schematic drawing of one position a user can assume for the performance of the present invention.
Figure 3B:
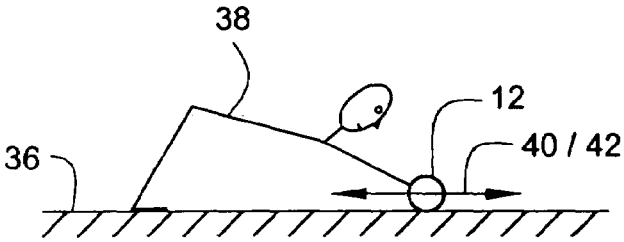
FIG. 3B is an alternative position a user can assume for the performance of the present invention.
Figure 3C:
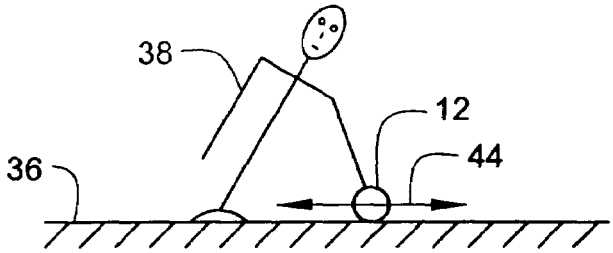
FIG. 3C is an alternative position a user can assume for the performance of the present invention.

In the operation of the present invention, the hand grip 10 can be used on a surface 36 by a user 38 as shown in FIGS. 3A, 3B, and 3C. Specifically, each wheel 12 and 14 of the present invention rotates about the axis 18 in resistance to an axle friction that is generated between each wheel 12 and 14 and the crossbar 16. Also, a rolling friction is generated between each rim 24 of the wheels 12 and 14 over the surface 36. As intended for the present invention, the axle friction is less than the rolling friction.

Figure 4A:
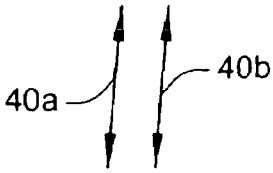
FIG. 4A is a drawing of one path a user can move the present invention on a surface.
Figure 4B:
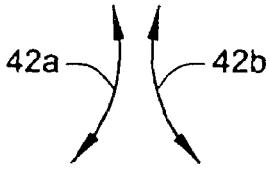
FIG. 4B is a drawing of an alternate path a user can move the present invention on a surface.

During an exercise routine, a user 38 can assume a kneeling position as shown in FIG. 3A, a bending-at-the-waist position as shown in FIG. 3B or a sitting position as shown in FIG. 3C. In more detail, the user 38 will hold the hand grip 10 of the present invention in each hand and roll the hand grip 10 back and forth on the surface 36 in any of the above-mentioned positions. The user 38 would apply his/her body weight on the hand grip 10 while rolling the hand grip 10. The user 38 has the option to roll the hand grip 10 along various paths as shown in FIGS. 4A and 4B. The user 38 can roll the hand grip 10 along a generally parallel path 40 (FIG. 4A) relative to the user 38 on the surface 36. Alternatively, the user 38 can roll the hand grip 10 on the surface 36 along a curved diverging/converging path 42 (FIG. 4B) or a lateral path 44 (FIG. 3C).

While the particular Hand Grip Exercise System as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A hand grip interactive with a surface, for use by an individual when performing an exercise routine, which comprises:

a crossbar defining an axis, said crossbar having a first end, and a second end, wherein said crossbar is formed with a bow at the center of said crossbar and wherein said bow is bent at an approximately forty-five degree angle;

a first wheel having a rounded rim, said first wheel being selectively mounted for rotation around said axis at said first end of said crossbar;

a second wheel having a rounded rim, said second wheel being selectively mounted for rotation around said axis at said second end of said crossbar; and means for providing a respective quick connect/disconnect of each said wheel wherein said means is directly attached to each said end of said crossbar;

wherein said first wheel and said second wheel independently rotate about said axis in resistance to respective axle friction and a rolling friction, the axle friction being generated between each said wheel and said crossbar, and the rolling friction being generated between said surface and said rim of respective said wheel during a movement of said hand grip over said surface, and further wherein said axle friction is less than said rolling friction.

2. A hand grip as recited in claim 1 wherein each said wheel is made of neoprene.

3. A hand grip as recited in claim 1 wherein each said wheel is attached to said connect/disconnect means of said crossbar.

4. A hand grip as recited in claim 1 wherein each said wheel has a hub for receiving said crossbar and wherein said hand grip further comprises a bearing means attached between each said hub of each said wheel and said crossbar for reducing the axle friction force therebetween.

5. A method for exercising selected muscles of an individual which comprises the steps of:

providing a hand grip, said hand grip comprising a crossbar defining an axis and having a first end, a second end and a central portion being between said first end and said second end, wherein said crossbar is formed with a bow at the center of said crossbar and wherein said bow is bent at an approximately forty-five degree angle, a first wheel having a rounded rim and being mounted at said first end of said crossbar for rotation around said axis, and a second wheel having a rounded rim and being mounted for rotation around said axis at said second end of said crossbar;

positioning the individual on a surface wherein said surface defines a substantially straight longitudinal axis on said surface and further wherein the individual is aligned with said longitudinal axis on said surface and said individual's hand rests on said central portion of said crossbar near said individual's body along said axis; and rolling said hand grip selectively outwardly from said individual on said surface in a free-form path by contraction of said individual's muscles.

6. A method as recited in claim 5 wherein said step of rolling is accomplished by moving said hand grip along generally parallel paths to said longitudinal axis on said surface.

7. A method as recited in claim 5 wherein said step of rolling is accomplished by moving said hand grip in a curving path radially from said longitudinal axis on said surface.

8. A method as recited in claim 5 wherein said step of positioning is accomplished by the individual being in a kneeling position.

9. A method as recited in claim 5 wherein said step of positioning is accomplished by the individual being in a sitting position.

10. A method as recited in claim 5 wherein said step of positioning is accomplished by the individual being in a bend-at-the-waist position.

* * * * *